US008991913B2

(12) United States Patent
Chen et al.

(10) Patent No.: US 8,991,913 B2
(45) Date of Patent: Mar. 31, 2015

(54) TRANSFORMABLE TATTOO CHAIR

(76) Inventors: Michael Chen, Baldwin Park, CA (US); Billy Chen, Baldwin Park, CA (US); Wen Wei, Baldwin Park, CA (US)

( * ) Notice: Subject to any disclaimer, the term of this patent is extended or adjusted under 35 U.S.C. 154(b) by 332 days.

(21) Appl. No.: 13/518,149

(22) PCT Filed: Nov. 11, 2010

(86) PCT No.: PCT/CN2010/001810

§ 371 (c)(1), (2), (4) Date: Oct. 2, 2012

(87) PCT Pub. No.: WO2011/075936

PCT Pub. Date: Jun. 30, 2011

(65) Prior Publication Data

US 2013/0038094 A1 Feb. 14, 2013

(30) Foreign Application Priority Data

Dec. 24, 2009 (CN) ..... 2009 2 0352382 U

(51) Int. Cl.
*A47C 4/00* (2006.01)
*A47C 4/20* (2006.01)
(Continued)

(52) U.S. Cl.
CPC . *A47C 4/20* (2013.01); *A47C 7/006* (2013.01); *A47C 15/004* (2013.01); *A47C 17/70* (2013.01); *A47C 19/122* (2013.01); *A61G 15/02* (2013.01); *A61G 15/12* (2013.01); *A61G 15/002* (2013.01); *A61G 2007/0518* (2013.01)
USPC ..... 297/16.1

(58) Field of Classification Search
CPC ... A61G 13/009; A61G 13/105; A47B 3/087; A47B 3/0912; A47C 4/20; A47C 17/70; A61H 2201/0161
USPC ..... 297/16.1, 19, 51, 53, 54
See application file for complete search history.

(56) References Cited

U.S. PATENT DOCUMENTS

| | | | | | |
|---|---|---|---|---|---|
| 36,441 | A | * | 9/1862 | Skinner | 5/111 |
| 4,684,170 | A | * | 8/1987 | Colby | 297/19 |
| 4,856,497 | A | * | 8/1989 | Westphal | 606/242 |
| 5,009,170 | A | * | 4/1991 | Spehar | 108/36 |
| 5,472,260 | A | * | 12/1995 | Czapski et al. | 297/112 |

(Continued)

FOREIGN PATENT DOCUMENTS

| | | |
|---|---|---|
| CN | 2917411 | 4/2007 |
| CN | 201119969 | 9/2008 |
| CN | 201571744 | 9/2010 |

OTHER PUBLICATIONS

International Search Report of PCT/CN2010/001810 dated Feb. 17, 2011.

*Primary Examiner* — Sarah B McPartlin
(74) *Attorney, Agent, or Firm* — Rankin, Hill & Clark LLP

(57) ABSTRACT

The present invention discloses a portable folding tattoo chair comprising a left part (100) and a right part (200), the left part (100) of the chair comprising a left cushion (101), a left fixing plate (102), a left fixing frame (103) and a left footing support (104); the right part (200) of the chair comprising a right cushion (201), a right fixing plate (202), a right fixing frame (203) and a right footing support (204); the left part (100) and the right part (200) of the chair being rotatable so as to be folded together, the left footing support (104) and the right footing support (204) being rotatable to be folded up. The tattoo chair in unfolding states may provide various auxiliary modes for different tattoo positions. The chair can also be folded after use to save space and transportation cost. The chair can be used as a pushcart to add functionality.

28 Claims, 12 Drawing Sheets

(51) Int. Cl.

| | |
|---|---|
| ***A47C 7/00*** | (2006.01) |
| ***A47C 15/00*** | (2006.01) |
| ***A47C 17/70*** | (2006.01) |
| ***A47C 19/12*** | (2006.01) |
| ***A61G 15/02*** | (2006.01) |
| ***A61G 15/12*** | (2006.01) |
| ***A61G 15/00*** | (2006.01) |
| *A61G 7/05* | (2006.01) |

(56) References Cited

U.S. PATENT DOCUMENTS

| | | | | |
|---|---|---|---|---|
| 6,684,426 | B1 * | 2/2004 | Lin et al. | 5/620 |
| 6,860,567 | B1 * | 3/2005 | Bauer | 297/144 |
| 7,428,762 | B1 * | 9/2008 | Kalies | 5/627 |
| 7,438,300 | B1 * | 10/2008 | Zien et al. | 280/79.5 |
| 2009/0249551 | A1 | 10/2009 | Klemm et al. | |
| 2009/0250565 | A1 | 10/2009 | Jaggers et al. | |

* cited by examiner

TRANSFORMABLE TATTOO CHAIR

FIELD OF THE INVENTION

The present invention generally relates to a tattoo chair, and more particularly, the invention relates to a portable folding tattoo chair.

BACKGROUND

Tattoo means to make pattern or message on skin by pricking the skin with a needle with colored dyes; to make permanent patterns by pricking the skin with a needle and then applying dyes on the wound; or to make ridgy scar on the skin.

Tattoo represents character and belief of a person, which comes from the custom of decorating skin in some primitive races in the world; i.e. to make non-fading pattern on some part of the body by operation. Tattoo patterns include bird, beast, flower, lection and trigram etc, reflecting the consciousness for beauty and religion ideas. In China, ethnic groups such as Gaoshan, Deang, Li, Dulong, Dai, Bulang and Jinuo have tattoo customs.

Usually, since making a tattoo needs a long time, the person being tattooed is required to hold a pose for a long time, which is difficult for the tattooed person without any auxiliary tool. Tattoo chair is often used as the auxiliary tool to a tattoo apparatus, which may help the tattooed person hold the pose easily.

There are some drawbacks in the existing tattoo chairs: 1) the chair is a tool for helping the tattooed person to hold pose in one position, which is unable to provide help when the tattooed person is in other tattoo positions; 2) the chair is of large size and occupies a large space, which requires more room for a tattoo shop; 3) the chair requires a large space in transportation, which increases the transportation cost; 4) it is inconvenient to move when being in use.

CONTENTS OF THE INVENTION

The present invention is designed to provide a portable folding tattoo chair. The unfolded tattoo chair may provide a plurality of positions for the tattooed person to hold poses. The tattoo chair may be folded after use to save space, facilitate transportation and lower transportation cost. The folded tattoo chair may also be used as a pushcart, which adds additional functionality.

To achieve the above technical effects, the present invention provides a tattoo chair comprising a left part and a right part. The left part of the chair comprises a left cushion, a left fixing plate, a left fixing frame and a left footing support. The right part of the chair comprises a right cushion, a right fixing plate, a right fixing frame and a right footing support. The left part and the right part of the chair are rotatably attached via connecting units so as to be folded together. Both of the left footing support and the right footing support are rotatable to be folded up.

Preferably, where the left fixing frame joints the right fixing frame, lugs are mounted on each side of the left fixing frame and the right fixing frame, and a pivot is provided for pivotably attaching the lug on each side of the left fixing frame and the lug on each sides of the right fixing frame. The arrangement of the lugs makes the left part and the right part of the chair be rotatable about the lug pivot, the rotation angle may be up to about 180 degrees, to fold the two parts of the chair up against each other. When the chair is in unfolding position, as the left fixing frame and the right fixing frame stand against each other, and also due to the function of the lugs and the pivot, the tattoo chair will be in a flat state and may not be rotated unlimitedly.

Preferably, the upper end of the left footing support is rotatably fixed to the left fixing frame and can only be rotated inwards to fold up. The upper end of the right footing support is rotatably fixed to the right fixing frame and can only be rotated inwards to fold up. Rotating the left footing support and right footing support inwards to fold the left and the right footing supports up and then folding the left part and right part of the chair about the pivots in lugs will reduce the floor space occupied by the tattoo chair by about 50%.

Preferably, the left footing support comprises a left horizontal bearer and a left vertical bearer. The upper end of the left vertical bearers is rotatably fixed to the left fixing frame. A left supporting strut is provided on the left vertical bearers. One end of the left supporting strut is rotatably fixed to the left vertical bearer. A left connecting strut is provided on the left fixing frame. One end of the left connecting strut is rotatably fixed to the left fixing frame. The middle part of the left connecting strut is pivotably attached to one end of the left supporting struts. With the left support strut on the left vertical bearer and the left connecting strut on the left fixing frame, the left footing support can be controlled to rotate within a fixed range and can be provided with stability.

Preferably, a small hole is provided on the end of the left connecting strut, and another small hole is provided symmetrically to the small hole about a rotatable pivot. An arc-like bulge matching the two small holes in size is provided on the middle part of the left supporting strut. The distance from the bulge to the rotatable pivot is equal to the distance from the rotatable pivot to the small holes. When the left vertical bearer stands vertically, the arc-like bulge will be caught in the small hole on the end of the left connecting strut, supporting the left footing support to provide stability. When the left vertical bearer 108 is rotated and the arc-like bulge separates from the small hole, the left vertical bearer, the left supporting strut and the left connecting strut rotate together. When the left vertical bearer is folded to a horizontal position, the arc-like bulge will be caught in another small hole to keep the stability in folding position.

Preferably, the left vertical bearer is adjustable in height. The height of the left vertical bearer can be adjusted according to the height of the tattooed person.

Preferably, the left vertical bearer is a hollow cylinder, into which an inner rod fixed to the horizontal bearer is inserted. A plurality of recesses is disposed on the inner rod. At the lower part of a pair of the left vertical bearer, a hollow adjusting bearer is provided. A left locking pin and a right locking pin are provided in the cavity of the hollow adjusting bearer. A spring is provided between the two pins. A left pin hole and a right pin hole, both in an oblong shape, are disposed on the sidewall of the adjusting bearer. One end part of the left locking pin is nearly right-angle bended and extends out from the left pin hole. One end part of the right locking pin is nearly right-angle bended and extends out from the right pin hole. When adjusting the height of the pair of the left vertical bearer, press hard on the end parts of the left locking pin and the right locking pin to compress the spring between the pins. The left and right locking pins escape from the recesses on the inner rods separately. Having adjusted the left vertical bearer to a suitable height, the end parts of the left and right locking pins are released. Under the force from the spring, the left and right locking pins will insert into the recesses on the inner rods to fix the height of the left vertical bearer.

Preferably, a ring clamp is provided on the lower part of the left vertical bearer to provide stability to the bearer.

Preferably, the right edge of the left fixing plate is rotatably fixed to the left fixing frame. Between the left fixing plate and the left fixing frame, a supporting device is provided for supporting the left fixing plate and adjusting the rotation height of the plate. The supporting device comprises a movable part and a fixed part. One end of the fixed part is rotatably fixed to the left fixing frame. The fixed part has a hollow cavity provided with odontoid steps. One end of the movable part is rotatably fixed to the left fixing plate, and the other end is inserted into the hollow cavity of the fixed part. The inserting end of the movable part has a structure matching the odontoid steps in the fixed part. The inserting end of the movable part is limited by the cavity of the fixed part and can move only within the cavity. Raising the left edge of the left fixing plate will make the plate rotate about its right edge, the movable part move up along the odontoid steps in the cavity of the fixed part at the same time to adjust the position of the movable part relative to the steps in the cavity according to the desired height.

Preferably, at least two lateral tapes of hooks are provided on upper surface of the left fixing plate, and at least two corresponding lateral tapes of loops are provided on the bottom surface of the left cushion.

Preferably, the right footing support comprises a right horizontal bearer and a right vertical bearer. The upper end of the right vertical bearers is rotatably fixed to the right fixing frame. A right supporting strut is provided on the right vertical bearers. One end of the right supporting strut is rotatably fixed to the right vertical bearer. A right connecting strut is provided on the right fixing frame. One end of the right connecting strut is rotatably fixed to the right fixing frame. The middle part of the right connecting strut is pivotably attached to one end of the right supporting struts. With the left support strut on the right vertical bearer and the right connecting strut on the right fixing frame, the right footing support can be controlled to rotate within a fixed range and can be provided with stability.

Preferably, a small hole is provided on the end of the right connecting strut, and another small hole is provided symmetrically to the small hole about a rotatable pivot. An arc-like bulge matching the two small holes in size is provided on the middle part of the right supporting strut. The distance from the bulge to the rotatable pivot is equal to the distance from the rotatable pivot to the small holes. When the right vertical bearer stands vertically, the arc-like bulge will be caught in the small hole on the end of the right connecting strut, supporting the right footing support to provide stability. When the right vertical bearer 108 is rotated and the arc-like bulge escapes from the small hole, the right vertical bearer, the right supporting strut and the right connecting strut rotate together. When the right vertical bearer is folded to a horizontal position, the arc-like bulge will be caught in another small hole to keep the stability in folding position.

Preferably, the right vertical bearer is adjustable in height. The height of the right vertical bearer can be adjusted according to the height of the tattooed person.

Preferably, the right vertical bearer is a hollow cylinder, into which an inner rod fixed to the horizontal bearer is inserted. A plurality of recesses is disposed on the inner rod. At the lower part of a pair of the right vertical bearer, a hollow adjusting bearer is provided. A left locking pin and a right locking pin are provided in the cavity of the hollow adjusting bearer. A spring is provided between the two pins. A left pin hole and a right pin hole, both in an oblong shape, are disposed on the sidewall of the adjusting bearer. One end part of the left locking pin is approximately right-angle bended and extends out from the left pin hole. One end part of the right locking pin is approximately right-angle bended and extends out from the right pin hole. When adjusting the height of the pair of the right vertical bearer, press hard on the end parts of the left locking pin and the right locking pin to compress the spring between the pins. The left and right locking pins escape from the recesses on the inner rods, respectively. Having adjusted the right vertical bearer to a suitable height, the end parts of the left and right locking pins are released. Under the force from the spring, the left and right locking pins will insert into the recesses on the inner rods to fix the height of the right vertical bearer.

Preferably, a ring clamp is provided on the lower part of the right vertical bearer to provide stability to the bearer.

Preferably, at least two lateral tapes of hooks are provided on upper surface of the right fixing plate, and at least two corresponding lateral tapes of loops are provided on the bottom surface of the right cushion.

Preferably, the right fixing frame comprises four lateral beams and two longitudinal beams fixed to the ends of the four lateral beams. The outer two of the four lateral beams are in hollow and tubular configuration. A "]"-shaped extension member is provided outside the right part of the chair. The rods of the extension member are inserted into the cavities of the two horizontal beams, respectively.

Preferably, a hollow protrusion is provided over each of the right ends of the two hollow horizontal beams. The cavity of the hollow protrusion is in communication with the cavity of the horizontal beam. The hollow protrusion matches the rod of "]"-shaped member. A fastening screw hole is provided on hollow protrusion. The rod of the "]"-shaped member may be inserted into the hollow protrusion for use according to the poses required for the tattooed person.

Preferably, handles are secured to the edge of left and right fixing frames, from the front view, respectively. The distance between the left handle and right handle and the inner size of the handles matches the rod of the "]"-shaped extension member. A fastening screw hole is provided on each handle on the left and right fixing frame. A bolt is used to secure the rod of the "]"-shaped extension member, and thus control the height and stability of the extension member.

Preferably, four roller wheels 138 are mounted under the left fixing frame, and two roller wheels are mounted under the right fixing frame. When both the left and right footing supports are folded up, the whole tattoo chair can be moved freely on the six wheels to form a pushcart. The rod of the "]"-shaped extension member can be vertically inserted into the hollow protrusion provided over the right end of the right fixing frame, to be used as a handrail of the pushcart.

Preferably, the "]"-shaped extension member comprises an outer rod, an inner rod, a lateral rod and a soft cushion surrounding the lateral rod. The outer rod is a hollow configuration and at least two location holes are provided on the surface. The inner rod is inserted into the outer rod, and location bulges matching with the location holes are provided on the surface of inner rod.

Preferably, at least two elastic straps are hanged on the rod of the "]"-shaped extension member.

The tattoo chair in unfolding states may provide various auxiliary modes for different tattoo positions. The chair can also be folded after use to save space and transportation cost. The chair can be used as a pushcart to add functionality.

BRIEF DESCRIPTION OF THE DRAWINGS

Below is the more particular description of the specific embodiments of the present invention as illustrated in the accompanying drawings:

FIG. 7 illustrates the chair of the present invention with the extension member in extension state of;

DESCRIPTION OF THE PREFERRED EMBODIMENT

Figure 1:
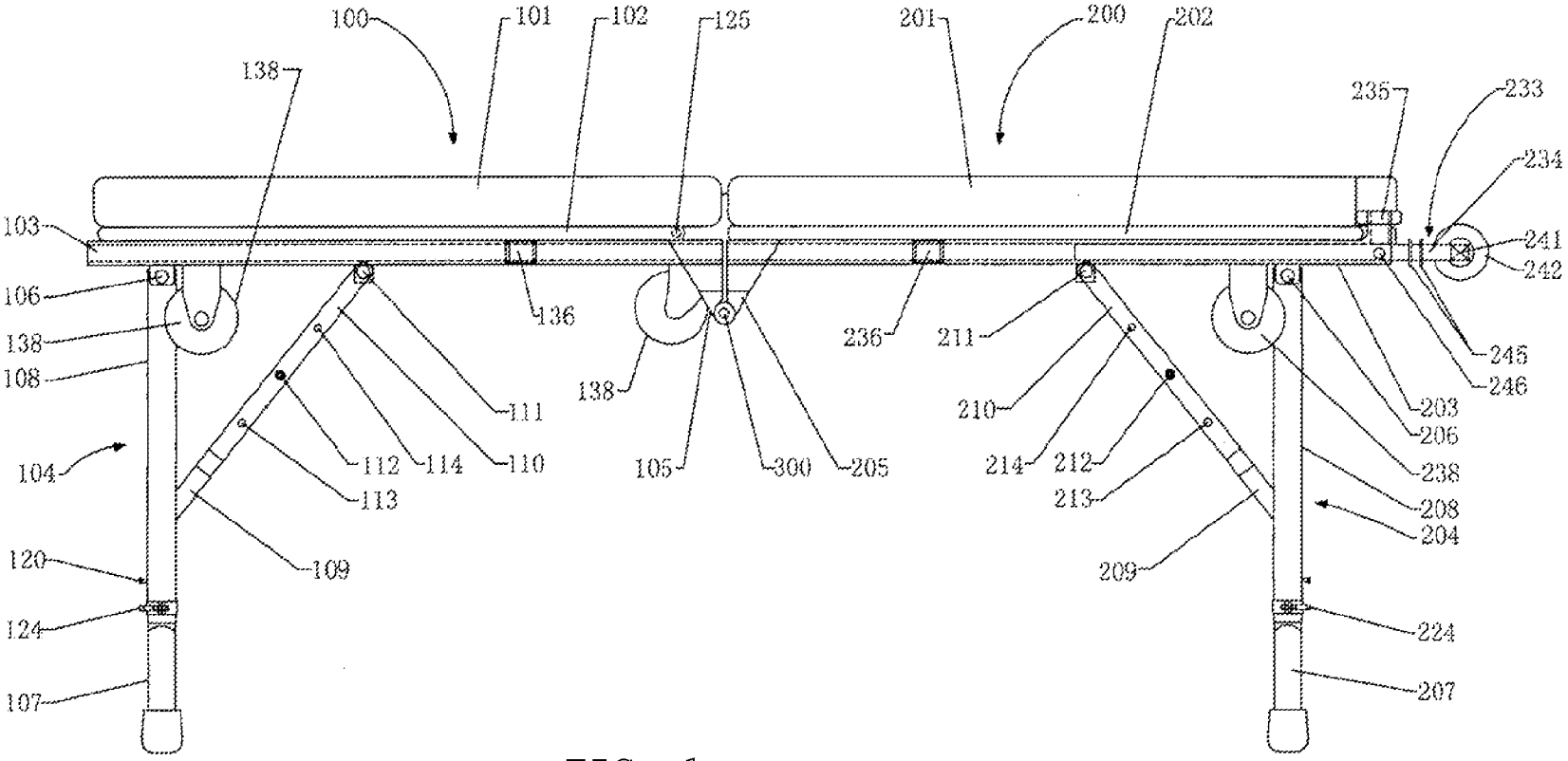
FIG. 1 illustrates the chair of the present invention in unfolding position.
Figure 2:
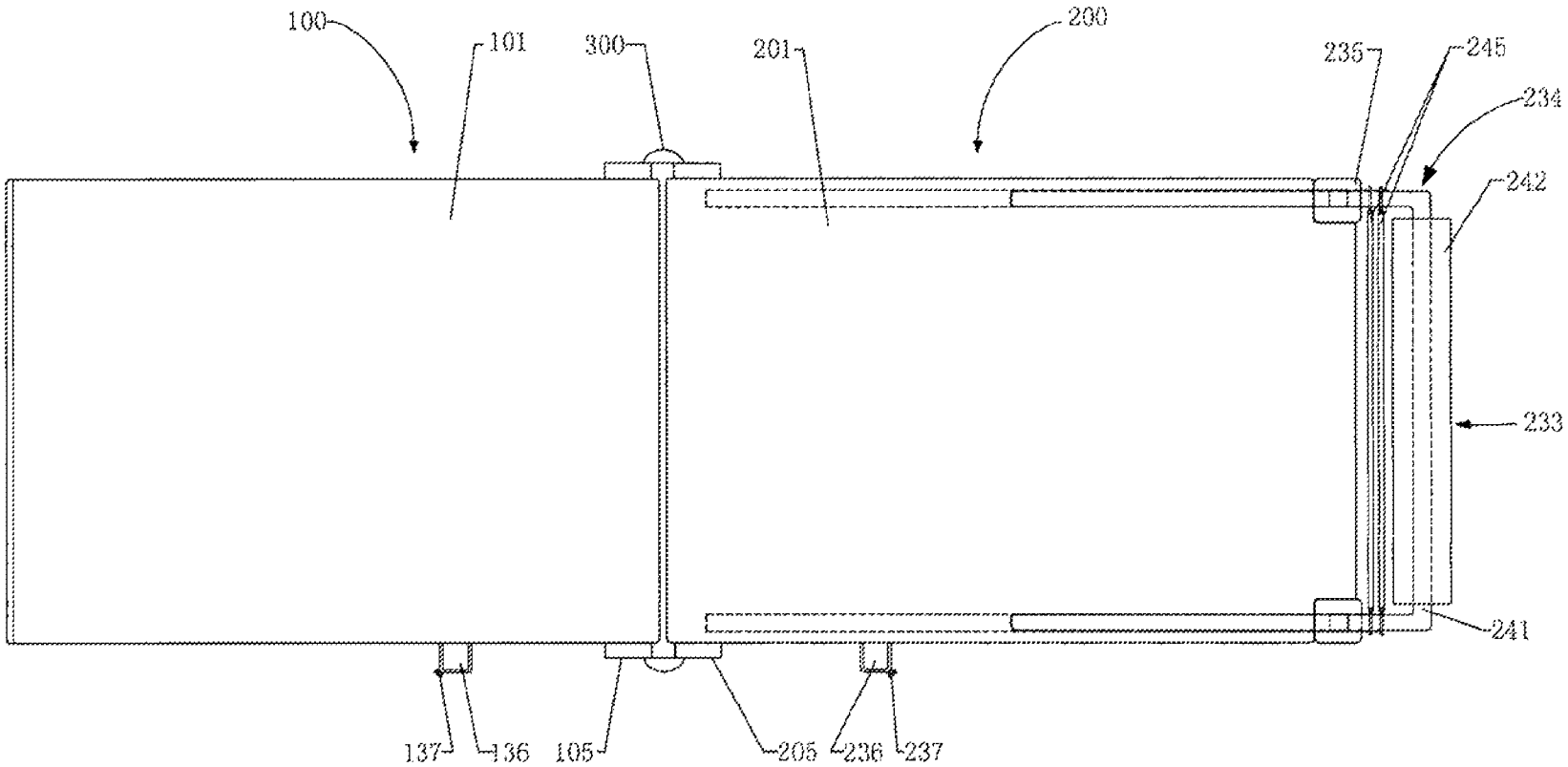
FIG. 2 is a plan view of FIG. 1.

Referring to FIG. 1, the tattoo chair of present invention comprises a left part 100 and a right part 200. The left part 100 of the chair comprises a left cushion 101, a left fixing plate 102, a left fixing frame 103 and a left footing support 104. The right part 200 of the chair comprises a right cushion 201, a right fixing plate 202, a right fixing frame 203 and a right footing support 204. The left part 100 and the right part 200 are rotatably attached via two connecting units so as to be folded together. Both of the left footing support 104 and the right footing support 204 can be rotated to fold to the frame.

Referring to FIGS. 1, 4, 5, 6, 8 and 9, in a preferred embodiment, the left part 100 and the right part 200 of the chair may be rotated to fold up in a following way: where the left fixing frame joints the right fixing frame, one lug 105 is mounted on each side of the left fixing frame 103, one lug 205 is mounted on each side of the right fixing frame 203, and a pivot 300 is used for pivotably attaching the lug 105 on each side of the left fixing frame 103 and the lug 205 on each sides of the right fixing frame 203. A connecting unit is thus formed by the lugs 105, 205 and the pivot 300. With the connecting units, the left part 100 and the right part 200 may be rotated about the pivots 300, the rotation angle being up to about 180 degrees, to fold the two parts of the chair up against each other. When the chair is unfolded, as the left fixing frame 103 and the right fixing frame 203 will stand against each other, and also due to the function of the lugs 105, 205 and the pivots 300, the tattoo chair will be in an unfolding and flat position and may not be rotated unlimitedly.

Referring to FIGS. 1, 4, 5, 6 and 10, in a preferred embodiment, the left footing support 104 and the right footing support 204 may be pivotably folded in the following way. The upper end of the left footing support 104 is rotatably fixed to the left fixing frame 103 via a pivot 106. The left footing support 104 can only be rotated inwards and folded. The upper end of the right footing support 204 is rotatably fixed to the right fixing frame 203 via a pivot 206, and the right footing support 204 can only be rotated inwards and folded. Folding the left footing support 104 and right footing support 204 and then folding the left part 100 and right part 200 of the chair about the pivots 300 in lugs 105 205 will reduce the floor space occupied by the tattoo chair by 50%.

Figure 5:
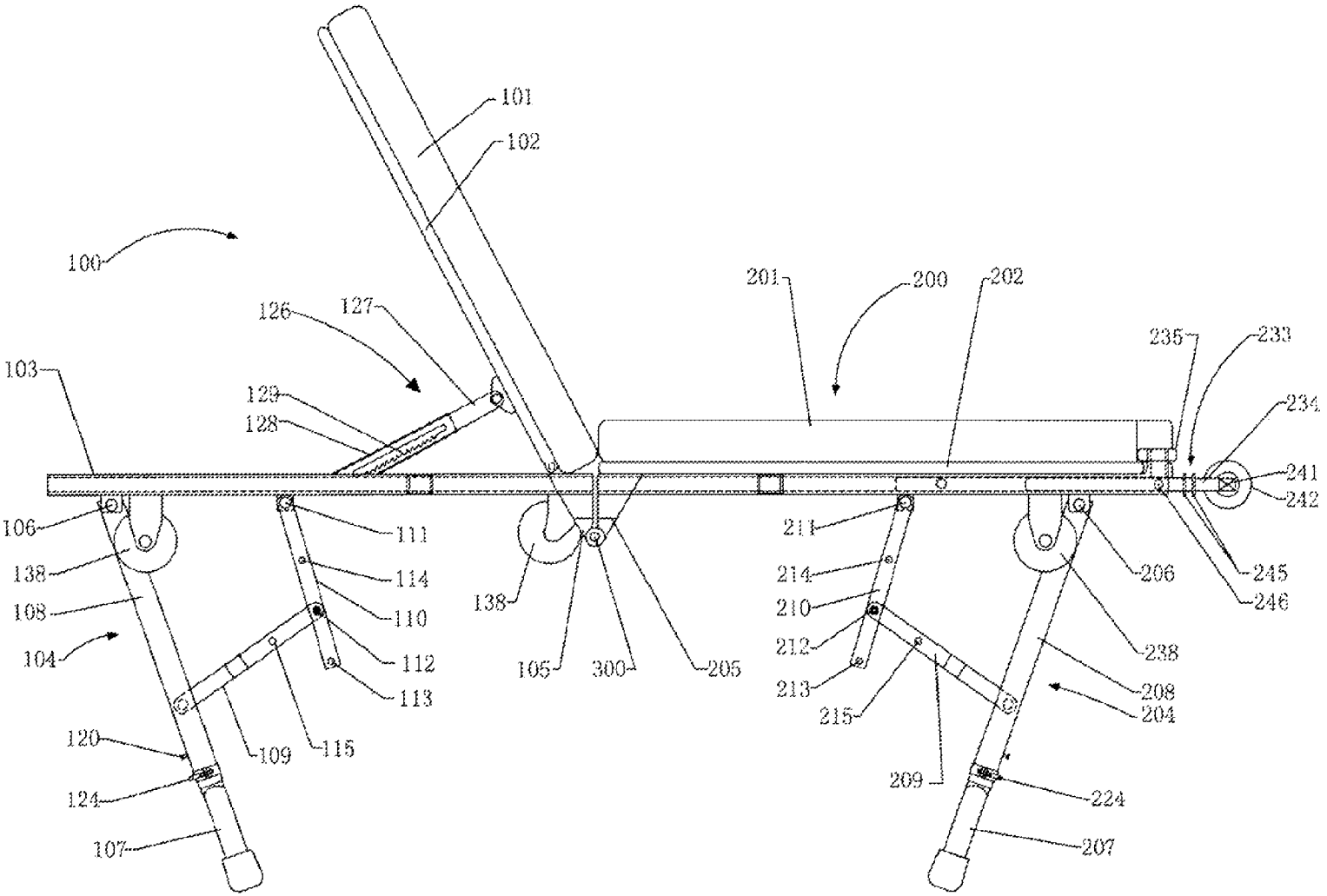
FIG. 5 illustrates the chair of the present invention while the left fixing frame being rotated, supported and fixed, and the left and right footing supports being in folding position.
Figure 6:
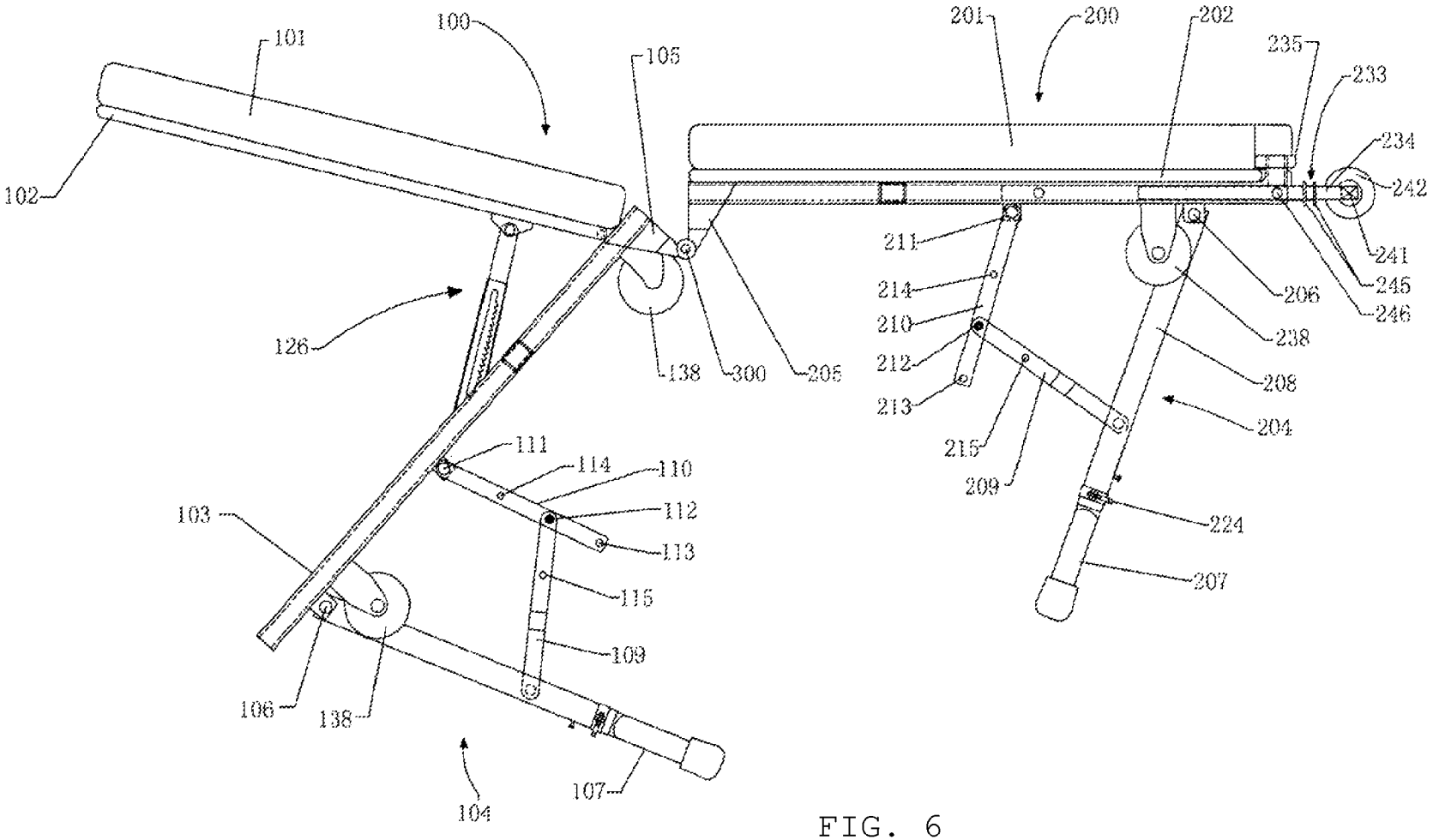
FIG. 6 illustrates the chair of the present invention while the left fixing frame being rotated and supported and fixed, the left and right supports being in folding position; and the left and right parts of the chair being in folding position.

Referring to FIGS. 5 and 6, in a preferred embodiment, the left footing support 104 comprises a left horizontal bearer 107 and a pair of left vertical bearer 108. The upper end of each left vertical bearers 108 is rotatably fixed to the left fixing frame 103 via a pivot 106. A pair of left supporting struts 109 is provided on the pair of the left vertical bearers 108, respectively. One end of each of the left supporting struts 109 is rotatably fixed to the left vertical bearer 108. A left connecting strut 110 is provided on the left fixing frame 103. The left connecting strut 110 is in a U-shape configuration and two ends of the U-shape configuration are rotatably fixed to the left fixing frame 103 via a pivot 111, respectively. The left connecting strut 110 is pivotably attached to both of the other ends of the pair of the left supporting struts 109 via pivots 112. The left footing support 104 can be rotated within a range of about 90-degree from a position of leaning on to a position of being perpendicular to the left fixing frame 103 and can provide stability by the pair of left supporting struts 109 on the left vertical bearer 108 and the left connecting strut 110 on left fixing frame 103.

Figure 10:
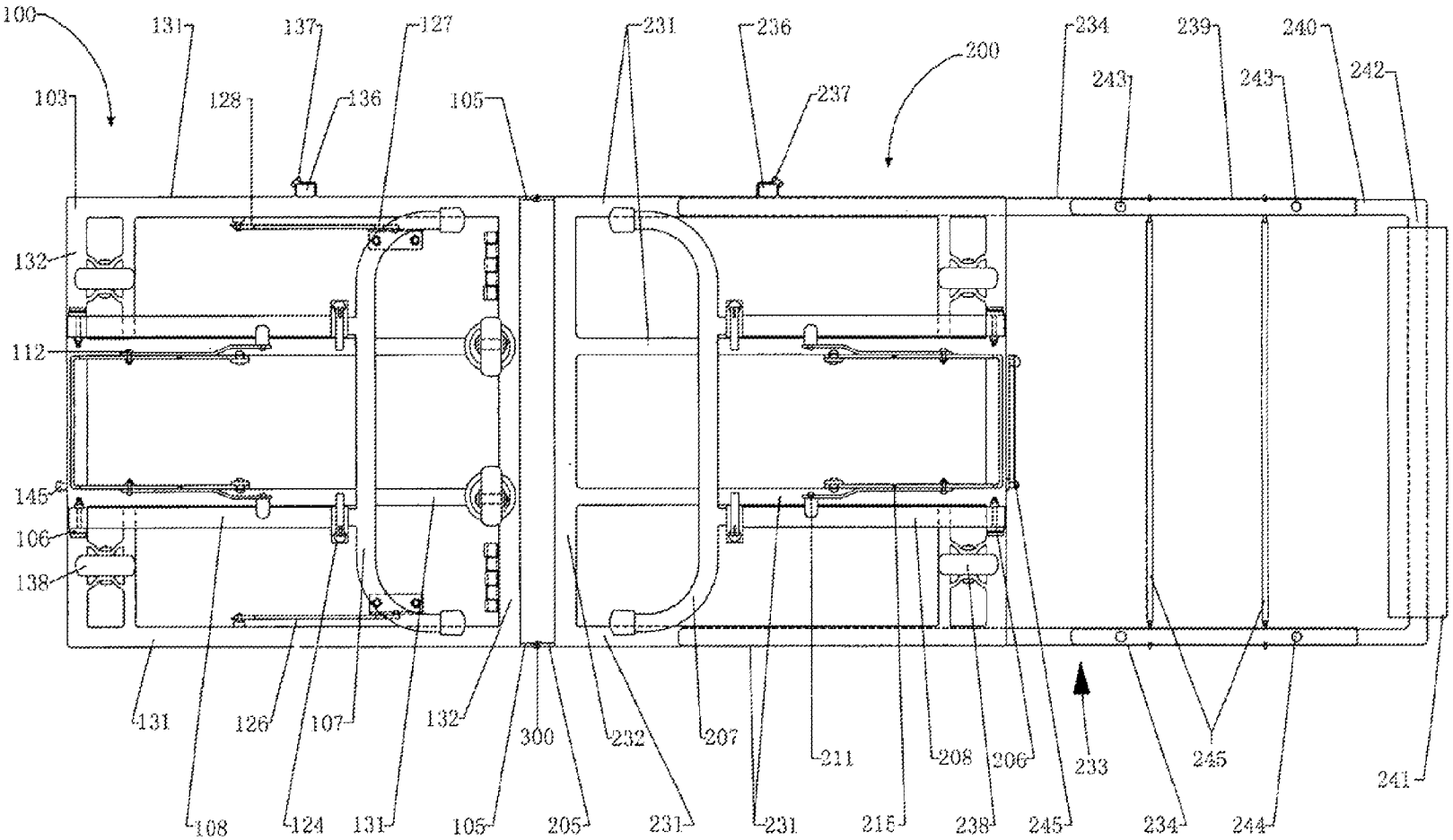
FIG. 10 is the bottom view of the chair with the left and right footing supports in completely folded position and the extension member in extension state.

Referring to FIGS. 5, 6 and 10, in a further improved embodiment, a small hole 113 is provided on one side of the left connecting strut 110, and another small hole 114 is provided symmetrically to the small hole 113 about the rotatable pivot 112. One bulge 115 in arc shape matching the two small holes in size is provided on the middle part of each left supporting strut 109. The distance from the bulge 115 to the rotatable pivot 112 is equal to the distance from the rotatable pivot 112 to the small hole 113, 114. When the left vertical bearer 108 stands vertically, the arc-like bulge 115 will be caught in the small hole 113 on the left connecting strut 110, supporting the left footing support 104 to provide stability. When the left vertical bearer 108 is rotated and the bulge 115 separates from the small hole 113, the left vertical bearer 108, the pair of the left supporting struts 109 and the left connecting strut 110 will rotate together. When the left vertical bearer 108 is folded to a horizontal position, the bulge 115 will be caught in another small hole 114 to keep the stability in folding position.

Figure 11:
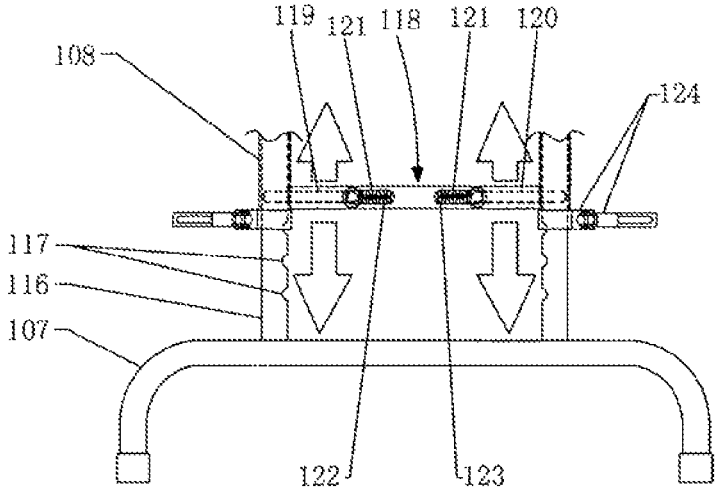
FIG. 11 illustrates the extension of the left and right footing supports of the present invention.

Referring to FIG. 11, in a further improved embodiment, the height of the pair of left vertical bearer 108 can be adjusted simultaneously. The left vertical bearer 108 is a hollow cylinder, into which an inner rod 116 fixed to the horizontal bearer 107 is inserted. A plurality of recesses 117 is disposed on the inner rod 116. At the lower parts of the pair of the left vertical bearer 108, a hollow adjusting bearer 118 is fixed between the vertical bearers 108. A left locking pin 119 and a right locking pin 120 are provided in the cavity of the hollow adjusting bearer 118. A spring 121 is provided between the two pins 119, 120. A left pin hole 122 and a right pin hole 123, both in an oblong shape, are disposed on the sidewall of the adjusting bearer 118. One end part of the left locking pin 119 is nearly right-angled bended and extends out from the left pin hole 122. One end part of the right locking pin 120 is nearly right-angled bended and extends out from the right pin hole 123. When adjusting the height of the pair of the left vertical bearer 108, press hard on the end parts of the left locking pin 119 and the right locking pin 120 to compress the spring 121 between the pins 119, 120. The left and right locking pins 119, 120 will separate from the recess 117 on the inner rod 116. Having adjusted the left vertical bearer 108 to a suitable height, the end parts of the left and right locking pins 119, 120 are released. Under the force from the spring, the left and right locking pins 119, 120 will insert into the recesses 117 on the inner rods 116 to fix the height of the left vertical bearer 108. The height of the left vertical bearer 108 thus is adjusted according to the height of person tattooed. Referring to FIGS. 1, 4, 5, 6, 8, 9 and 11, in a preferred embodiment, a ring clamp 124 is provided on the lower part of the left vertical bearer 108 to provide stability.

Figure 4:
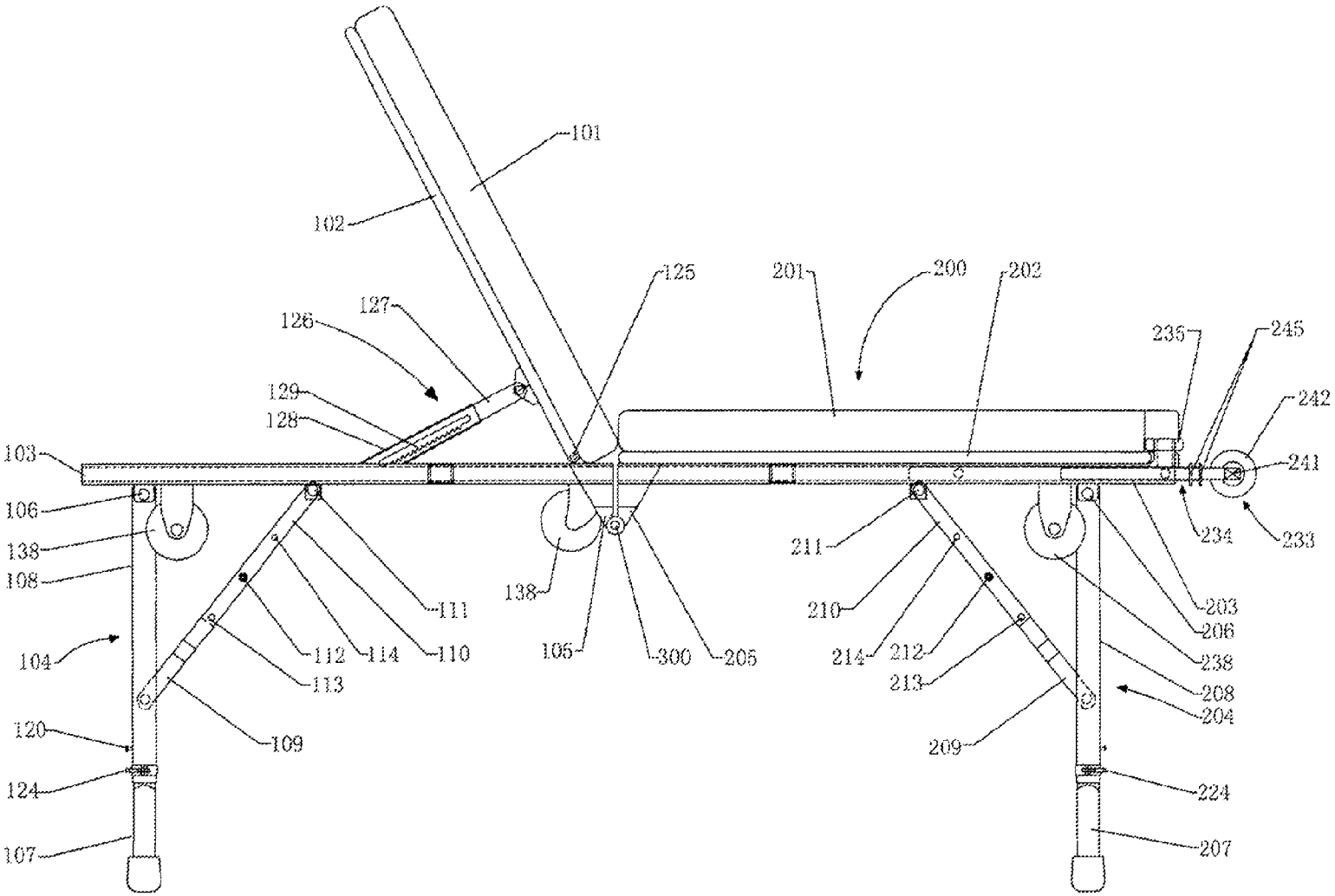
FIG. 4 illustrates the chair of the present invention in unfolding position while the left fixing frame being rotated, supported and fixed.
Figure 13:
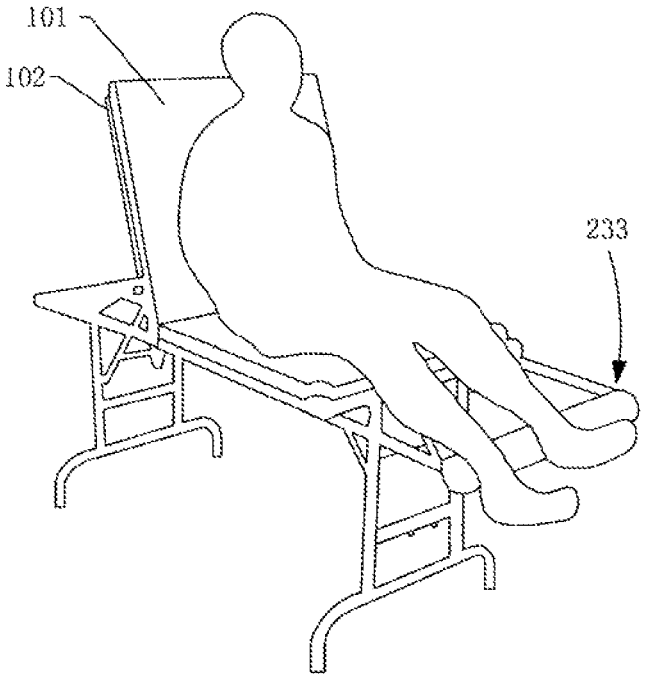
FIG. 13 is the schematic of another specific embodiment of the chair in use.

Further referring to FIGS. 4, 5 and 6, in a further improved embodiment, the right part of the left fixing plate 102 is rotatably fixed to the left fixing frame 103 via a hinge 125. Between the left fixing plate 102 and the left fixing frame 103, a supporting device 126 is provided for supporting the left fixing plate 102 and adjusting the height of the plate. The supporting device 126 comprises a movable part 127 and a fixed part 128. One end of the fixed part 128 is rotatably fixed to the left fixing frame 103. The fixed part 128 has a hollow cavity provided with odontoid steps 129. One end of the movable part 127 is rotatably fixed to the left fixing plate 102, and the other end is inserted into the hollow cavity of the fixed part 128. The inserting end of the movable part 127 has a structure matching the odontoid steps 129 in the fixed part 128. The inserting end of the movable part is limited by the cavity of the fixed part 128 and can move only in the cavity. Raising the left edge of the left fixing plate 102 makes the plate rotate about its right edge, the movable part 127 will move up along the odontoid steps 129 in the cavity of the fixed part 128 at the same time, so as to adjust the position of the movable part 127 relative to the steps in the cavity to satisfy the desired height. FIG. 13 shows the profile of a specific embodiment in which the left fixing plate 102 rotating and supporting the tattooed person.

Figure 3:
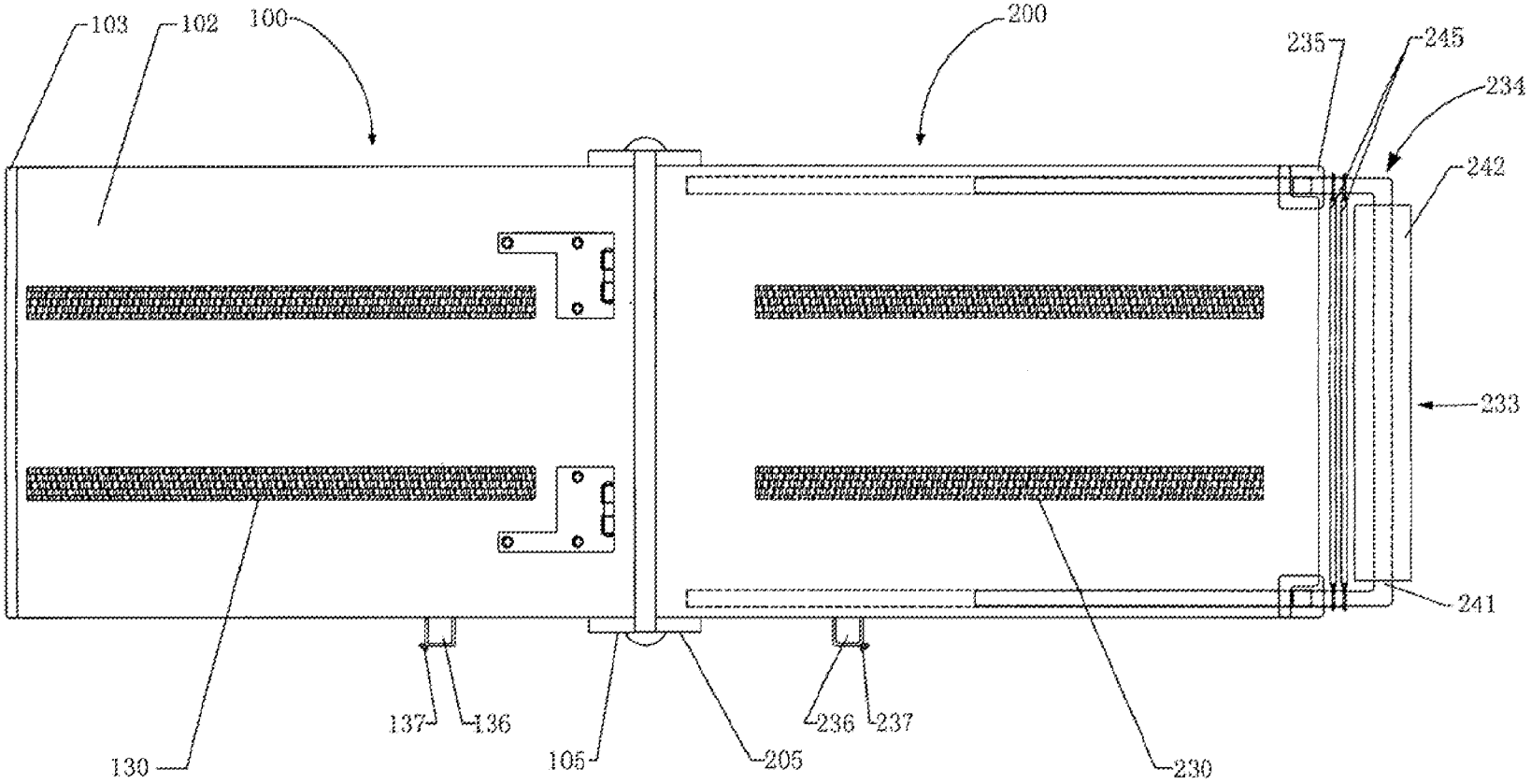
FIG. 3 illustrates the chair of FIG. 2 without the left and right cushions.

Referring to FIG. 3, in a further improved embodiment, at least two lateral nylon fastening tapes 130, such as hooks, are provided on upper surface of the left fixing plate 102 and the tapes corresponding to the tapes 130, such as loops (not shown!), are provided on the bottom surface of the left cushion 101. Through the design of fastening tapes 130, the left cushion 101 can be easily removed from and installed on the left fixing frame 103.

Referring to FIGS. 1, 4, 5, 6, 8, 9 and 10, in a preferred embodiment, the right footing support 204 comprises a right horizontal bearer 207 and a pair of right vertical bearer 208. The upper end of each right vertical bearer 108 is rotatably fixed to the right fixing frame 203 via a pivot 206. A pair of right supporting struts 209 is provided on the pair of the right vertical bearers 208, respectively. One end of each of the right supporting bearers 209 is rotatably fixed to the right vertical bearer 208. A right connecting strut 210 is provided on the right fixing frame 203. The right connecting strut 210 is in a U-shape configuration and two ends of the U-shape configuration are rotatably fixed to the right fixing frame 203 via a pivot 211, respectively. The right connecting strut 210 is pivotably attached to both of the other ends of the pair of the right supporting struts 209 via pivots 212. The right footing support 204 can be rotated within a range of about 90-degree from a position of leaning on to a position of being perpendicular to the right fixing frame 203 and can provide stability by the pair of right supporting struts 209 on the right vertical bearer 208 and the right connecting strut 210 on right fixing frame 203.

Referring to FIGS. 5, 6 and 10, in a further improved embodiment, a small hole 213 is provided on one side of the right connecting strut 210, and another small hole 214 is provided symmetrically to the small hole 213 about the rotatable pivot 212. One bulge 215 in arc shape matching the two small holes in size is provided on the middle part of each right supporting strut 209. The distance from the bulge 215 to the rotatable pivot 212 is equal to the distance from the rotatable pivot 212 to the small hole 213, 214. When the right vertical bearer 208 stands vertically, the bulge 215 will be caught in the small hole 213 on the right connecting bearer 210, supporting the right footing support 204 to provide stability. When the right vertical bearer 208 is rotated and the bulge 115 separates from the small hole, the right vertical bearer 108, the pair of the right supporting struts 109 and the right connecting strut 110 will rotate together. When the right vertical bearer 208 is folded to a horizontal position, the bulge 215 will be caught in another small hole 214 to keep the stability in folding position.

Referring to FIG. 11, in a further improved embodiment, the pair of right vertical bearer 208 has a structure for adjusting the height simultaneously. For the tattooed people in different height, the height of the right vertical bearer 208 thus can be adjusted to comply with corresponding requirement.

Referring to FIG. 11, in a further improved embodiment, the left footing support 104 and the right footing support 204 are of the same structure. That is, the right vertical bearer 208 is a hollow cylinder, into which an inner rod fixed to the horizontal bearer is inserted. A plurality of recesses is provided on the inner rod. At the lower parts of the pair of the left vertical bearer, a hollow adjusting bearer is provided. A left locking pin and a right locking pin are provided in the cavity of the hollow adjusting bearer. A spring is provided between the two pins. A left pin hole and a right pin hole, both in an oblong shape, are disposed on the sidewall of the adjusting bearer. One end part of the left locking pin is nearly right-angled bended and extends out from the left pin hole. One end part of the right locking pin is nearly right-angled bended and extends out from the right pin hole. When adjusting the height of the pair of the right vertical bearer, press hard on the end parts of the left locking pin and the right locking pin to compress the spring between the pins. The left and right locking pins will separate from the recesses on the left and right inner rods. Having adjusted the right vertical bearer to a suitable height, the end parts of the left and right locking pins are released. Under the force from the spring, the left and right locking pins will insert into the recesses on the inner rods to fix the height of the right vertical bearer.

Referring to FIGS. 1, 4, 5, 6, 8, 9 and 11, in a preferred embodiment, a ring clamp 224 is provided on the lower part of the right vertical bearer 208 to provide stability.

Referring to FIG. 3, in a further improved embodiment, at least two lateral nylon fastening tapes 230, such as hooks, are provided on the right fixing plate 202 and the tapes corresponding to the tapes 230, such as loops (not shown!), are provided on the bottom surface of the right cushion 201. Through the design of fastening tapes 230, the right cushion 201 can be easily removed from and installed on the right fixing frame 103.

Figure 12:
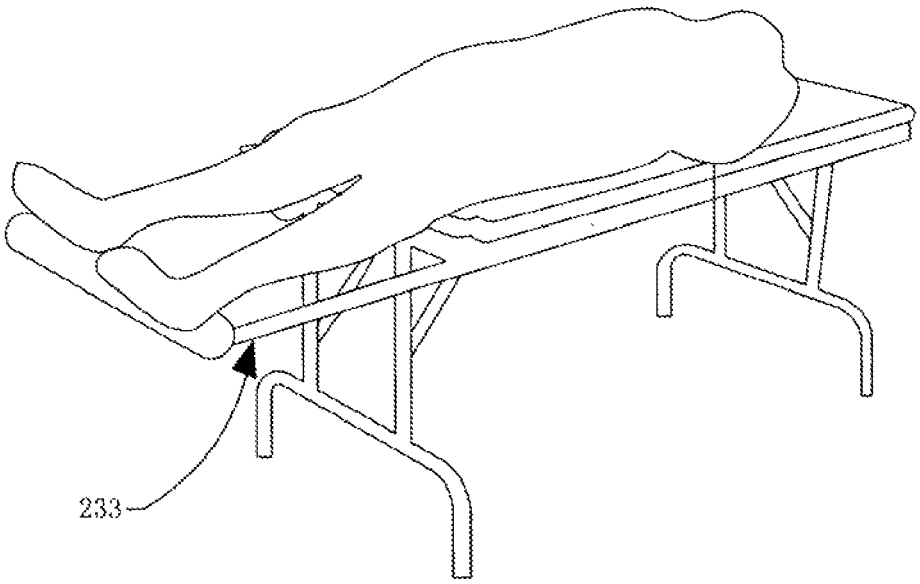
FIG. 12 is the schematic of a specific embodiment of the chair in use.

Referring to FIG. 10, in a further improved embodiment, the left fixing frame 103 comprises four lateral beams 131 and two longitudinal beams 132 fixed to the ends of the four lateral beams 131. The right fixing frame 203 comprises four lateral beams 231 and two longitudinal beams 232 fixed to the ends of the four lateral beams 231. The outer two of the four lateral beams 231 on the right fixing frame 203 are in hollow and tubular configuration. A "]"-shaped extension member 233 is provided outside the right part 200 of the chair. The rod 234 of the extension member 233 is inserted into the cavities of the two horizontal beams 231, respectively. Referring to FIG. 12, the arrangement of the extension member 233 may be used to extend the length of the chair when the person being tattooed lies in the chair. FIG. 12 shows an embodiment of the present invention.

Figure 8:
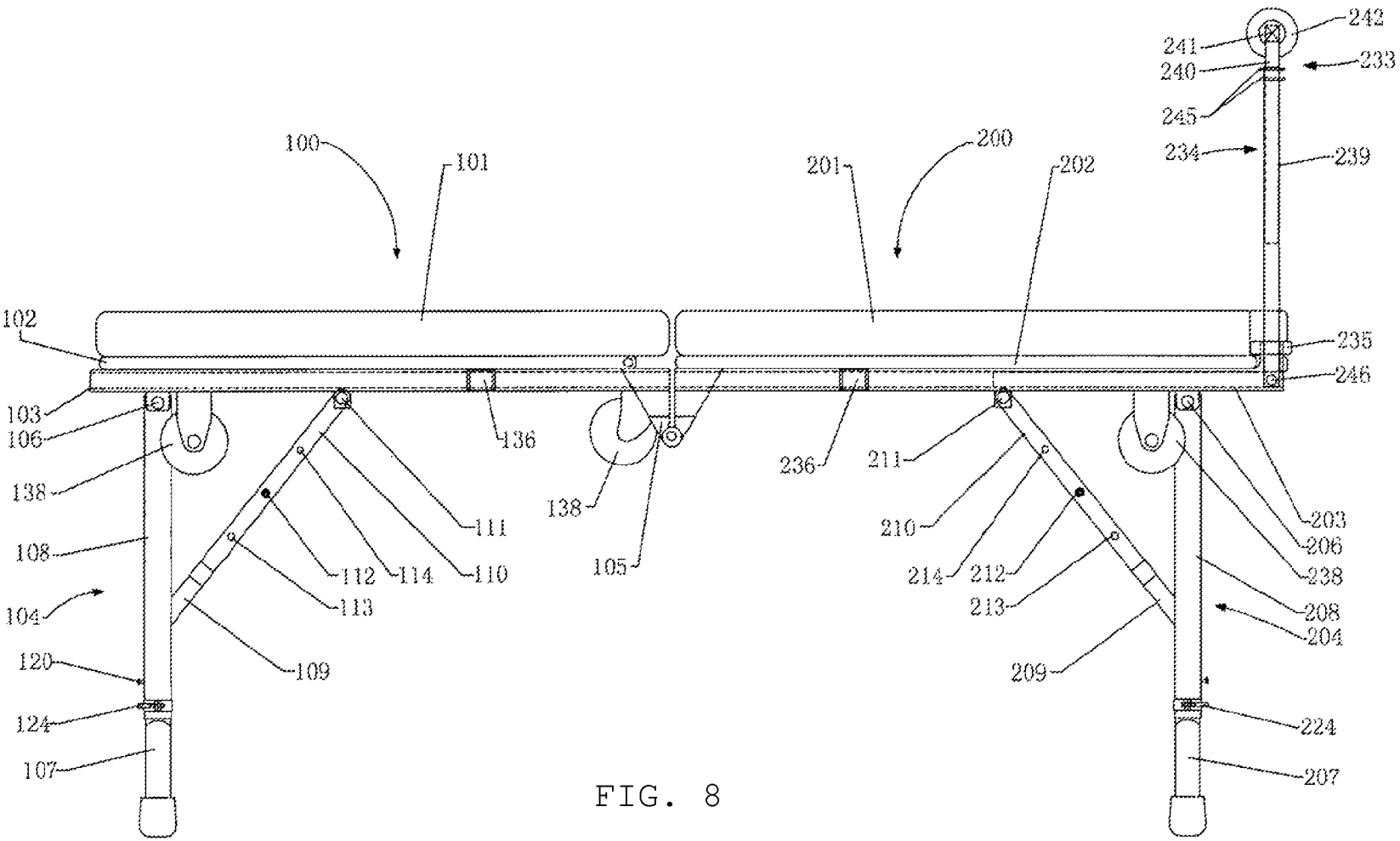
FIG. 8 illustrates the chair of the present invention with the extension member inserted and fixed in the hollow protrusion over the right end of right fixing frame.
Figure 9:
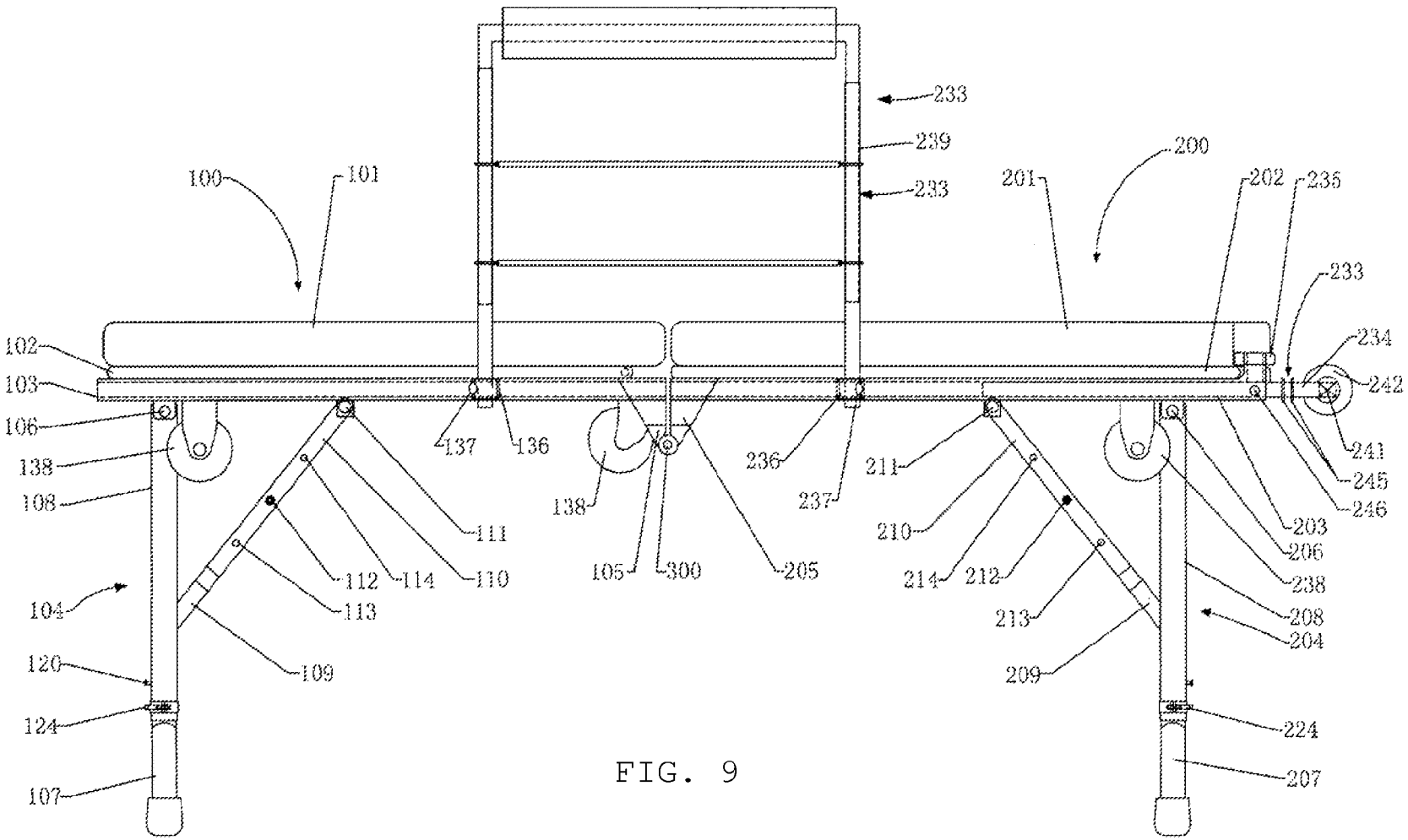
FIG. 9 illustrates the chair of the present invention with the extension member inserted and fixed in the handles on the left and right fixing frames.

Referring to FIG. 8, in a further improved embodiment, a hollow protrusion 235 is provided over each of the right ends of the two hollow horizontal beams 231. The cavity of the hollow protrusion 235 (also referred to herein as a mounting structure) is in communication with the cavity of the horizontal beam 231. The hollow protrusion 235 matches the rod 234 of "]"-shaped extension member 233. A fastening screw hole 246 is provided on the sidewall of the horizontal beam 231 communicating with the hollow protrusion 235. After the rod 234 of the "]"-shaped extension member 233 is inserted into the hollow protrusion 235, a bolt is used to fix it. The rod 234 of the "]"-shaped extension member 233 may be used to insert into the protrusion 235 according to the poses required for the tattooed person.

Figure 14:
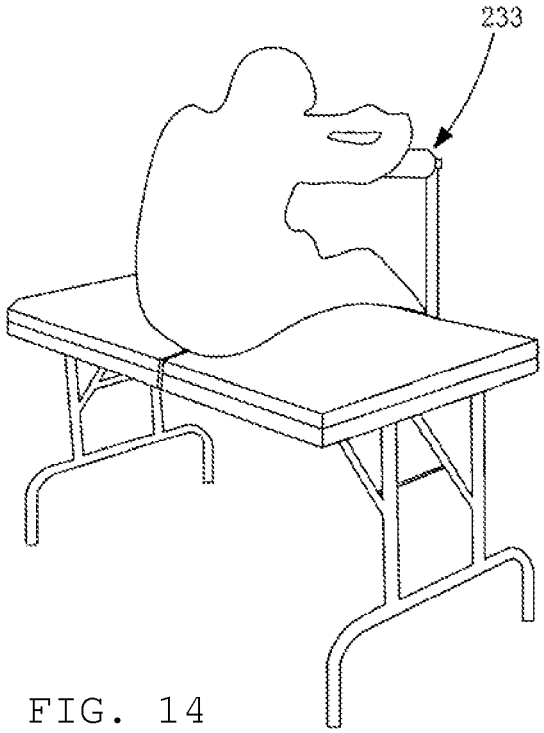
FIG. 14 is the schematic of one more embodiment of the chair in use.

Referring to FIGS. 1, 3, 4, 7 and 9, in a further improved embodiment, handles 136 and 236 (also referred to herein as mounting structures) are secured to the edge of left and right fixing frames 103, 203 from the front view, respectively. The distance between the left handle 136 and right handle 236 and the inner size of the handle matches the rod 234 of the "]"-shaped member. A fastening screw hole 137, 237 is provided on each handle on the left and right fixing frame 103 and 203. The angle between the center line of screw hole 137, 237 and the horizontal center line of the chair is about 45 degrees. A bolt is used to secure the rod 234 of the "]"-shaped extension member 233, and thus control the height and stability of the member. FIG. 14 shows an embodiment of the present invention.

Referring to FIGS. 1, 4, 5, 6, 8, 9 and 10, in a further improved embodiment, four roller wheels 138 are mounted under the left fixing frame 103, and two roller wheels 238 are mounted under the right fixing frame 203. When both the left and right footing supports 104, 204 are folded, the whole tattoo chair can be moved freely on the six wheels, like a pushcart. The rod 234 of the "]"-shaped extension member 233 can be vertically inserted into the hollow protrusion 235 provided over the right end of the right fixing frame 203, to be used as a handrail of the pushcart.

Figure 7:
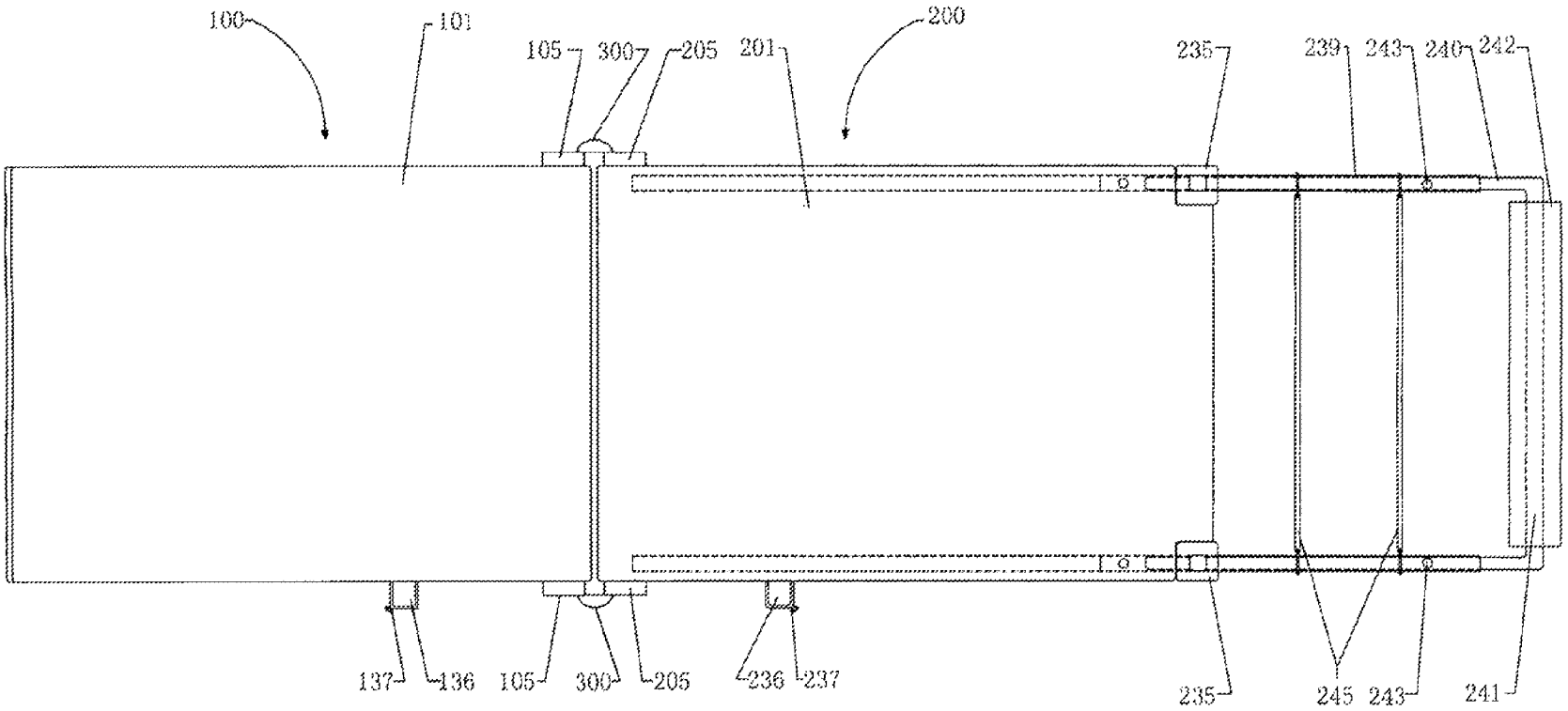

Referring to FIGS. 7 and 10, in a further improved embodiment, the "]"-shaped extension member 233 comprises an outer rod 239, an inner rod 240, a lateral rod 241 and a soft cushion 242 surrounding the lateral rod 241. The outer rod 239 is a hollow configuration and at least two location holes 243 are provided on the surface. The inner rod 240 is inserted into the outer rod 239, and location bulges 244 are provided on the surface of inner rod 240, which matches the location holes 243 on the outer rod 239.

Referring to FIGS. 7 and 10, in a further improved embodiment, at least two elastic straps 245 are hanged on the rod 234 of the "]"-shaped extension member 233.

Referring to FIG. 10, in a further improved embodiment, a lock buckle 145 is provided on the outer edge of left fixing frame 103, and a lock handle 245 on the outer edge of the right fixing frame 203, the lock buckle 145 and the lock handle 245 are matching each other. When the left part 100 and the right part 200 of the chair are folded completely, the lock handle 245 fastens the lock buckle 145, inhibiting over rotation of the two parts.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. Additionally, features of various implementing embodiments may be combined to form further embodiments of the invention.

The invention claimed is:

1. A portable folding tattoo chair comprising:

a left part and a right part of the chair, the left part of the chair comprising a left cushion, a left fixing plate, a left fixing frame and a left footing support;

the right part of the chair comprising a right cushion, a right fixing plate, a right fixing frame and a right footing support, the left part and the right part of the chair being rotatably attached via a connecting unit so as to be folded together, the left footing support and the right footing support being rotatable to be folded up, wherein the right fixing frame comprises a pair of lateral beams and a longitudinal beam fixed to ends of the lateral beams, the lateral beams having a hollow and tubular configuration, and an extension member is provided outside the right part of the chair, the extension member including rods configured for insertion into cavities of the lateral beams, and wherein a pair of mounting structures each defining a mounting aperture is disposed on one or both of the left and right fixing frames for mounting the extension member in alternative positions, a distance between each of the pair of mounting structures matching a distance between the rods of the extension member and a size of the mounting aperture matching a size of the rod of the extension member to be inserted into the mounting aperture.

2. The portable folding tattoo chair according to claim 1, wherein the left fixing frame jointing the right fixing frame, one lug being mounted on each side of the left fixing frame, one lug being mounted on each side of the right fixing frame, and a pivot being provided for pivotably attaching the lug on each side of the left fixing frame and the lug on each side of the right fixing frame.

3. The portable folding tattoo chair according to claim 1, wherein an upper end of the left footing support is rotatably fixed to the left fixing frame and is rotatable only inwards to fold up, and an upper end of the right footing support is rotatably fixed to the right fixing frame and is rotatable only inwards to fold up.

4. The portable folding tattoo chair according to claim 3, wherein the left footing support is adjustable in height.

5. The portable folding tattoo chair according to claim 3, wherein the right footing support is adjustable in height.

6. The portable folding tattoo chair according to claim 3, wherein a lock buckle is provided on an outer edge of left fixing frame, and a lock handle on an outer edge of the right fixing frame, the lock buckle and the lock handle matches each other.

7. The portable folding tattoo chair according to claim 1, wherein the left footing support comprises a left horizontal bearer and a left vertical bearer, an upper end of the left vertical bearer is rotatably fixed to the left fixing frame via a pivot, a left supporting strut is provided on the left vertical bearer, one end of the left supporting strut is rotatably fixed to the left vertical bearer, a left connecting strut is provided on the left fixing frame, one end of the left connecting strut is rotatably fixed to the left fixing frame via a pivot, and a middle part of the left connecting strut is pivotably attached to an opposite end of the left supporting strut via pivots.

8. The portable folding tattoo chair according to claim 1, wherein the right edge of the left fixing plate is rotatably fixed to the left fixing frame via a hinge, and a supporting device is provided between the left fixing plate and the left fixing frame for supporting the left fixing plate and adjusting the rotation height of the left fixing plate, the supporting device comprises a movable part and a fixed part, one end of the fixed part is rotatably fixed to the left fixing frame, the fixed part has a hollow cavity provided with odontoid steps, one end of the movable part is rotatably fixed to the left fixing plate, and the other end is inserted into the hollow cavity of the fixed part, the inserting end of the movable part has a structure matching the odontoid steps in the fixed part and limited by the cavity of the fixed part and can move only within the cavity.

9. The portable folding tattoo chair according to claim 1, wherein at least two lateral tapes of hooks are provided on upper surface of the left fixing plate, and at least two corresponding lateral tapes of loops are provided on the bottom surface of the left cushion.

10. The portable folding tattoo chair according to claim 1, wherein the right footing support comprises a right horizontal bearer and a right vertical bearer, an upper end of the right vertical bearer is rotatably fixed to the right fixing frame via a pivot, a right supporting strut is provided on the right vertical bearer, one end of the right supporting strut is rotatably fixed to the right vertical bearer, a right connecting strut is provided on the right fixing frame, one end of the right connecting strut is rotatably fixed to the right fixing frame via a pivot, and a middle part of the right connecting strut is pivotably attached to an opposite end of the right supporting strut via pivots.

11. The portable folding tattoo chair according to claim 1, wherein the left fixing frame comprises four lateral beams and two longitudinal beams fixed to ends of the four lateral beams, the right fixing frame comprises four lateral beams and two longitudinal beams fixed to ends of the four lateral beams, and the rods of the extension member are inserted into the cavities of an outer pair of the lateral beams, respectively, of the right fixing frame.

12. The portable folding tattoo chair according to claim 11, wherein the pair of mounting structures is provided as a hollow protrusion over each of right ends of the two outer lateral beams, the hollow protrusion is a square shape, and a cavity of the hollow protrusion is in communication with the cavity of the outer lateral beam, the hollow protrusion matches the size of each rod of the extension member.

13. The portable folding tattoo chair according to claim 12, wherein a fastening screw hole is provided on sidewall of the outer lateral beam in communication with the hollow protrusion.

14. The portable folding tattoo chair according to claim 1, wherein the pair of mounting structures are a pair of handles secured to a front or rear edge of the left and right fixing frames, respectively.

15. The portable folding tattoo chair according to claim 14, wherein a fastening screw hole is provided on each handle on the left and right fixing frame, an angle between a center line of the fastening screw hole and a horizontal center line of the chair is about 45 degrees.

16. The portable folding tattoo chair according to claim 1, wherein the extension member comprises an outer rod, an inner rod, a lateral rod and a soft cushion surrounding the lateral rod, the outer rod is a hollow configuration and has at least two location holes on the surface, the inner rod is inserted into the outer rod, and location bulges matching with the location holes are provided on the surface of inner rod.

17. The portable folding tattoo chair according to claim 1, wherein at least two elastic straps are provided on one of the rods of the extension member.

18. The portable folding tattoo chair according to claim 1, wherein at least one roller wheel is mounted under the left fixing frame, and at least one roller wheel is mounted under the right fixing frame.

19. The portable folding tattoo chair according to claim 18, wherein four roller wheels are mounted under the left fixing frame, and two roller wheels are mounted under the right fixing frame.

20. The portable folding tattoo chair according to claim 1, wherein the pair of mounting structures is a pair of hollow protrusions located at or adjacent a distal end of the right fixing frame for mounting the extension member in an upright position that is orthogonal to the right fixing frame.

21. The portable folding tattoo chair according to claim 1, wherein the pair of mounting structures is located at or adjacent an outer end of the right fixing frame and at least one wheel is mounted under the right fixing frame, the rods of the extension member insertable into the mounting apertures defined by the mounting structures for configuring the portable folding tattoo chair as a pushcart and the extension member as a handrail for the pushcart.

22. A portable folding tattoo chair comprising:

a left part and a right part of the chair, the left part of the chair comprising a left cushion, a left fixing plate, a left fixing frame and a left footing support;

the right part of the chair comprising a right cushion, a right fixing plate, a right fixing frame and a right footing support;

the left part and the right part of the chair being rotatably attached via a connecting unit so as to be folded together, the left footing support and the right footing support being rotatable to be folded up, wherein the left footing support comprises a left horizontal bearer and a left vertical bearer, an upper end of the left vertical bearer is rotatably fixed to the left fixing frame via a pivot, a left supporting strut is provided on the left vertical bearer, one end of the left supporting strut is rotatably fixed to the left vertical bearer, a left connecting strut is provided on the left fixing frame, one end of the left connecting strut is rotatably fixed to the left fixing frame via a pivot, and a middle part of the left connecting strut is pivotably attached to an opposite end of the left supporting strut via pivots, wherein a small hole is provided on the end of the left connecting strut, another small hole is provided symmetrically to the small hole about a rotatable pivot, and a bulge matching the two small holes in size is provided on the middle part of the left supporting strut, the distance from the bulge to the rotatable pivot is equal to the distance from the rotatable pivot to the small holes.

23. The portable folding tattoo chair according to claim 22, wherein the left vertical bearer is a hollow cylinder, into which an inner rod fixed to the horizontal bearer is inserted, a plurality of recesses is disposed on the inner rod, a hollow adjusting bearer is provided at the lower part of a pair of the left vertical bearer, a left locking pin and a right locking pin are provided in the cavity of the hollow adjusting bearer, a spring is provided between the left and the right locking pins, a left pin hole and a right pin hole, both in an oblong shape, are disposed on the sidewall of the adjusting bearer, one end part of the left locking pin is approximately right-angle bended and extends out from the left pin hole, and one end part of the right locking pin is approximately right-angle bended and extends out from the right pin hole.

24. The portable folding tattoo chair according to claim 23, wherein a ring clamp is provided on the lower part of the left vertical bearer.

25. A portable folding tattoo chair comprising:

a left part and a right part of the chair, the left part of the chair comprising a left cushion, a left fixing plate, a left fixing frame and a left footing support;

the right part of the chair comprising a right cushion, a right fixing plate, a right fixing frame and a right footing support;

the left part and the right part of the chair being rotatably attached via a connecting unit so as to be folded together, the left footing support and the right footing support being rotatable to be folded up, wherein the right footing support comprises a right horizontal bearer and a right vertical bearer, an upper end of the right vertical bearer is rotatably fixed to the right fixing frame via a pivot, a right supporting strut is provided on the right vertical bearer, one end of the right supporting strut is rotatably fixed to the right vertical bearer, a right connecting strut is provided on the right fixing frame, one end of the right connecting strut is rotatably fixed to the right fixing frame via a pivot, and a middle part of the right connecting strut is pivotably attached to an opposite end of the right supporting strut via pivots, wherein a small hole is provided on the end of the right connecting strut, another small hole is provided symmetrically to the small hole about a rotatable pivot, and a bulge matching the two small holes in size is provided on the middle part of the right supporting strut, the distance from the bulge to the rotatable pivot is equal to the distance from the rotatable pivot to the small holes.

26. The portable folding tattoo chair according to claim 25, wherein the right vertical bearer is a hollow cylinder, into which an inner rod fixed to the horizontal bearer is inserted, a plurality of recesses is disposed on the inner rod, a hollow adjusting bearer is provided at the lower part of a pair of the right vertical bearer, a left locking pin and a right locking pin are provided in the cavity of the hollow adjusting bearer, a spring is provided between the left and the right locking pins, a left pin hole and a right pin hole, both in an oblong shape, are disposed on the sidewall of the adjusting bearer, one end part of the left locking pin is approximately right-angle bended and extends out from the left pin hole, and one end part of the left locking pin is approximately right-angle bended and extends out from the right pin hole.

27. The portable folding tattoo chair according to claim 25, wherein a ring clamp is provided on the lower part of the right vertical bearer.

28. The portable folding tattoo chair according to claim 27, wherein at least two lateral tapes of hooks are provided on upper surface of the right fixing plate, and at least two corresponding lateral tapes of loops are provided on the bottom surface of the right cushion.

* * * * *